US009272284B2

(12) United States Patent
Martens et al.

(10) Patent No.: US 9,272,284 B2
(45) Date of Patent: Mar. 1, 2016

(54) GRINDING ROLLER OF A ROLLER MILL

(75) Inventors: Ralf Martens, Beckum (DE); Herbert Pingel, Wadersloh (DE)

(73) Assignee: ThyssenKrupp Industrial Solutions AG (DE)

( * ) Notice: Subject to any disclaimer, the term of this patent is extended or adjusted under 35 U.S.C. 154(b) by 353 days.

(21) Appl. No.: 13/988,539

(22) PCT Filed: Nov. 28, 2011

(86) PCT No.: PCT/EP2011/071156

§ 371 (c)(1), (2), (4) Date: May 21, 2013

(87) PCT Pub. No.: WO2012/079965

PCT Pub. Date: Jun. 21, 2012

(65) Prior Publication Data

US 2013/0248630 A1 Sep. 26, 2013

(30) Foreign Application Priority Data

Dec. 17, 2010 (DE) ..... 10 2010 061 309

(51) Int. Cl.
*B02C 4/02* (2006.01)
*B02C 4/30* (2006.01)

(52) U.S. Cl.
CPC .. *B02C 4/305* (2013.01); *B02C 4/02* (2013.01)

(58) Field of Classification Search
CPC ..... B02C 4/305; B02C 4/02
USPC ..... 241/294, 121, 300, 295
See application file for complete search history.

(56) References Cited

U.S. PATENT DOCUMENTS

| | | | | |
|---|---|---|---|---|
| 1,885,241 | A | 11/1932 | Duckworth | |
| 2,588,900 | A * | 3/1952 | Warsmith | 241/294 |
| 4,546,527 | A | 10/1985 | Fukuda et al. | |
| 6,086,003 | A | 7/2000 | Gunter et al. | |
| 2012/0048976 | A1 * | 3/2012 | Hofmann et al. | 241/230 |

FOREIGN PATENT DOCUMENTS

DE 2843173 A1 4/1979

* cited by examiner

*Primary Examiner* — Mark Rosenbaum
(74) *Attorney, Agent, or Firm* — Renner Kenner Greive Bobak Taylor & Weber

(57) ABSTRACT

The grinding roller of a roller mill according to the invention consists essentially of a roller shaft, a main roller body and an external wear ring having a wear protection, wherein the connection between the roller shaft and the main roller body is formed by a shrink fit. The main roller body is formed by at least two coaxially arranged intermediate rings.

9 Claims, 3 Drawing Sheets

GRINDING ROLLER OF A ROLLER MILL

The invention relates to a grinding roller of a roller mill, having a roller shaft, a main roller body and an outer wear ring having wear protection. The invention relates additionally to a roller mill for the comminution of brittle grinding stock, which roller mill has two grinding rollers which can be driven in opposite directions.

A roller for the processing of iron or steel in thin sheets or strips according to the precharacterising clause of claim 1 is known from U.S. Pat. No. 1,938,995 A. It comprises a roller shaft with a roller body fitted by a shrink fit, the roller body having a heat-treated, hardened surface.

DE 28 43 173 C2 provides, as a wear-resistant surface armouring for rollers of roller-based machines, a plurality of metal layers of different materials or hardnesses which are welded onto a main roller body.

From DE 94 22 077 U1 there is known a grinding roller for a roller press, which grinding roller has a main roller body applied to a stepped one-piece shaft 3 and, fastened thereto, a wear ring which is in one piece or is divided into a plurality of segments.

Very high grinding pressures of up to 50 MPa or more can be used in roller mills or roller presses. In the comminution of brittle material, such as, for example, limestone, wear of the outer wear ring occurs during operation. It is therefore conventional to condition worn grinding rollers repeatedly by twisting off the wear ring and providing a new wear protection, for example by build-up welding. In the case of a repeatedly reconditioned grinding roller with a diameter of 240 cm and a width of 170 cm, about 40 t of material must nevertheless be scrapped.

It is additionally known to form the wear protection by shaped bodies which protrude from the surface of the wear ring and can likewise be replaced once they have become worn.

After usually about 2 to 4 conditioning operations, the main roller body that remains has to be disposed of, unless it can be used for a grinding roller with a smaller diameter.

The object underlying the invention is, therefore, to lower the operating costs of a grinding roller or roller mill by extended use of the roller body.

The object is achieved according to the invention by the features of claim 1 and of claim 8.

The grinding roller of a roller mill according to the invention consists essentially of a roller shaft, a main roller body, and an outer wear ring having wear protection, the connection between the roller shaft and the main roller body being formed by a shrink fit. The main roller body is formed by at least two coaxially arranged intermediate rings.

By dividing the main roller body into at least two coaxially arranged intermediate rings it is sufficient to replace only the outermost intermediate ring after repeated conditioning, whereas it was hitherto necessary to replace the whole of the main roller body. As a result of this construction, the operating costs of a roller mill can be reduced by up to 10%, depending on the number of intermediate rings.

The main roller body, or the intermediate rings, are cast steel parts or forged parts, the radial strength of which is limited by production-related considerations. As a result of its being divided into a plurality of intermediate rings, the grinding roller according to the invention has the further advantage that the overall diameter of the main roller body can be enlarged significantly by a correspondingly increased number of intermediate rings. Grinding rollers with large diameters of at least 3 m, preferably at least 3.5 m or more, can therefore be produced without difficulty.

Further embodiments of the invention are the subject of the dependent claims.

The connections between the intermediate rings and between the outer intermediate ring and the wear ring are preferably likewise formed by shrink fits, it being possible to use either a conical or a cylindrical shrink fit. A cylindrical shrink fit will be chosen especially in the case of connections that are not to be dismantled later, while a conical shrink fit can be dismantled without difficulty. In that respect, a conical shrink fit is particularly advantageous for connecting the outermost intermediate ring to the wear ring and to the inwardly adjacent intermediate ring.

According to a further embodiment of the invention, the grinding roller can have a diameter of at least 4.5 m and a width of at least 2.5 m. In addition, it is advantageous in the case of grinding rollers with larger diameters to provide at least three or four intermediate rings.

The wear protection can further be formed by shaped bodies which protrude from the surface of the wear ring and/or by a hard build-up weld.

According to a preferred use, the above-described grinding rollers are used in a roller mill for the comminution of brittle grinding stock, in which two grinding rollers that can be driven in opposite directions are provided. This can be in particular a high-pressure roller mill, in which a force application system that is in operative connection with at least one grinding roller is provided for generating a grinding pressure of at least 50 MPa.

Further embodiments and advantages of the invention will be described in greater detail below by means of the description and the drawings.

Figure 1:
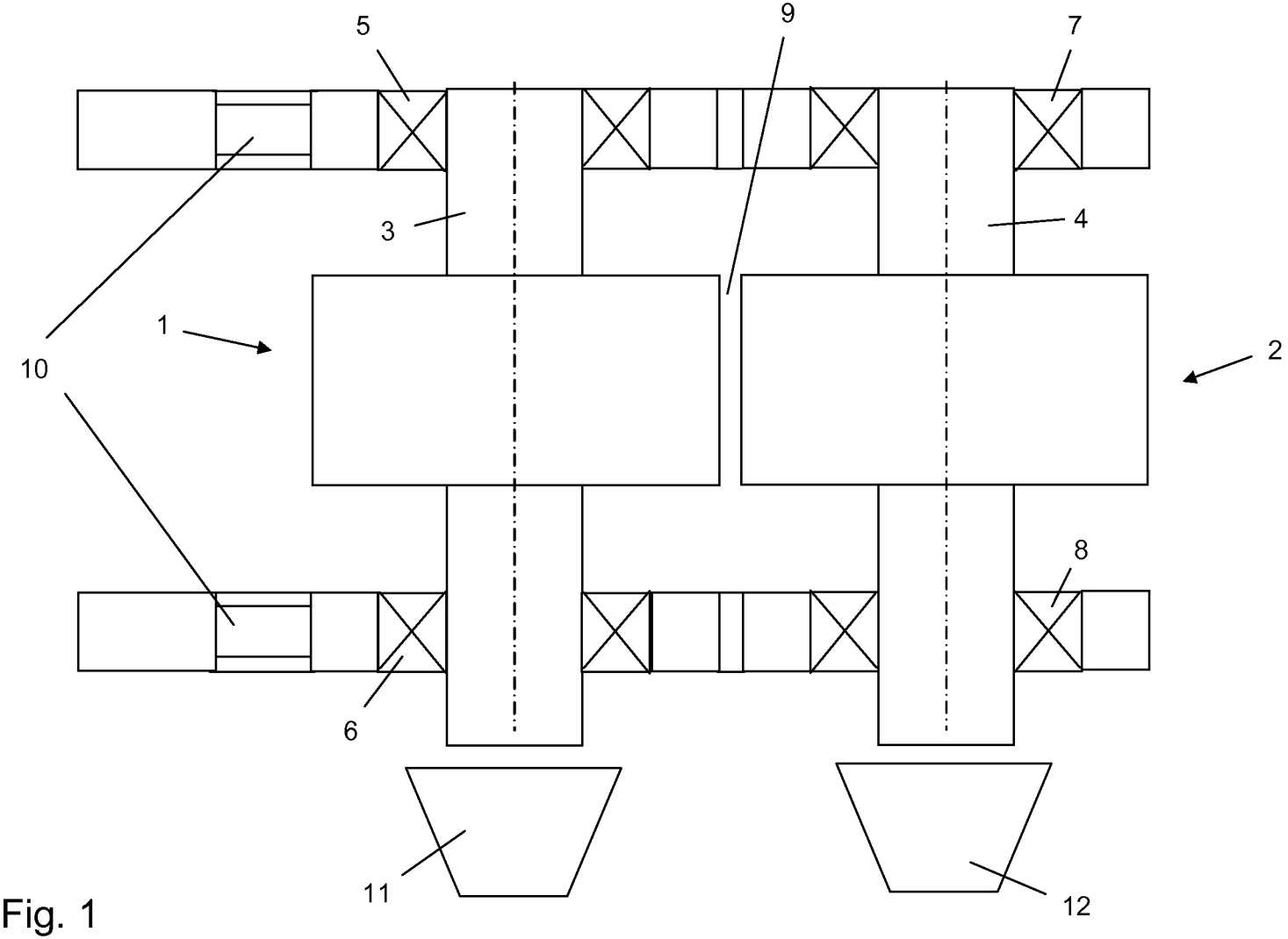
FIG. 1 shows a schematic top view of a roller mill.

The roller mill shown in FIG. 1 for the comminution of brittle grinding stock substantially comprises grinding rollers 1, 2, the roller shafts 3, 4 of which are mounted in bearings 5, 6 and 7, 8. The bearings 5 to 8 are preferably slide bearings. An adjustable grinding gap 9 is maintained between the two grinding rollers 1, 2, and the required grinding pressure of, for example, at least 50 MPa is generated by way of a force application system 10. The two grinding rollers 1, 2 are driven in opposite directions by way of drives 11, 12 coupled to the roller shafts 3, 4.

Although the roller mill shown is preferably a high-pressure roller press, other mills are also conceivable according to the invention, such as, for example, a vertical roller mill, in which the grinding rollers described in greater detail below could likewise be used.

Since the two grinding rollers 1, 2 are identical in construction, two exemplary embodiments will be described in greater detail below by means of FIGS. 2 and 3 solely on the basis of the grinding roller 1.

In the exemplary embodiment shown, the grinding roller 1 comprises the roller shaft 3, a main roller body 13, and an outer wear ring 14 having wear protection. In the exemplary embodiment shown, the main roller body 13 is formed by three coaxially arranged intermediate rings 13*a*, 13*b* and 13*c*, it being possible for the intermediate rings 13*a* to 13*c* of the roller body to be produced from different materials. Accordingly, it is conceivable that only the outer intermediate ring 13*c* is produced from conventional, relatively expensive roller bearing steel, for example 18NiCrMo14-6, while a sufficiently strong structural steel, for example S355J2G3, is used for the other intermediate rings 13*a* and 13*b*. As a result of this possibility, the procurement situation for the material of the roller body is noticeably relaxed. In addition, structural steel is cheaper than roller bearing steel.

The connection of the individual parts of the grinding roller is carried out by means of a shrink fit, both a conical and a cylindrical shrink fit in principle being conceivable. Conical shrink fits are preferred especially in the case of connections that are later to be dismantled again.

Figure 2:
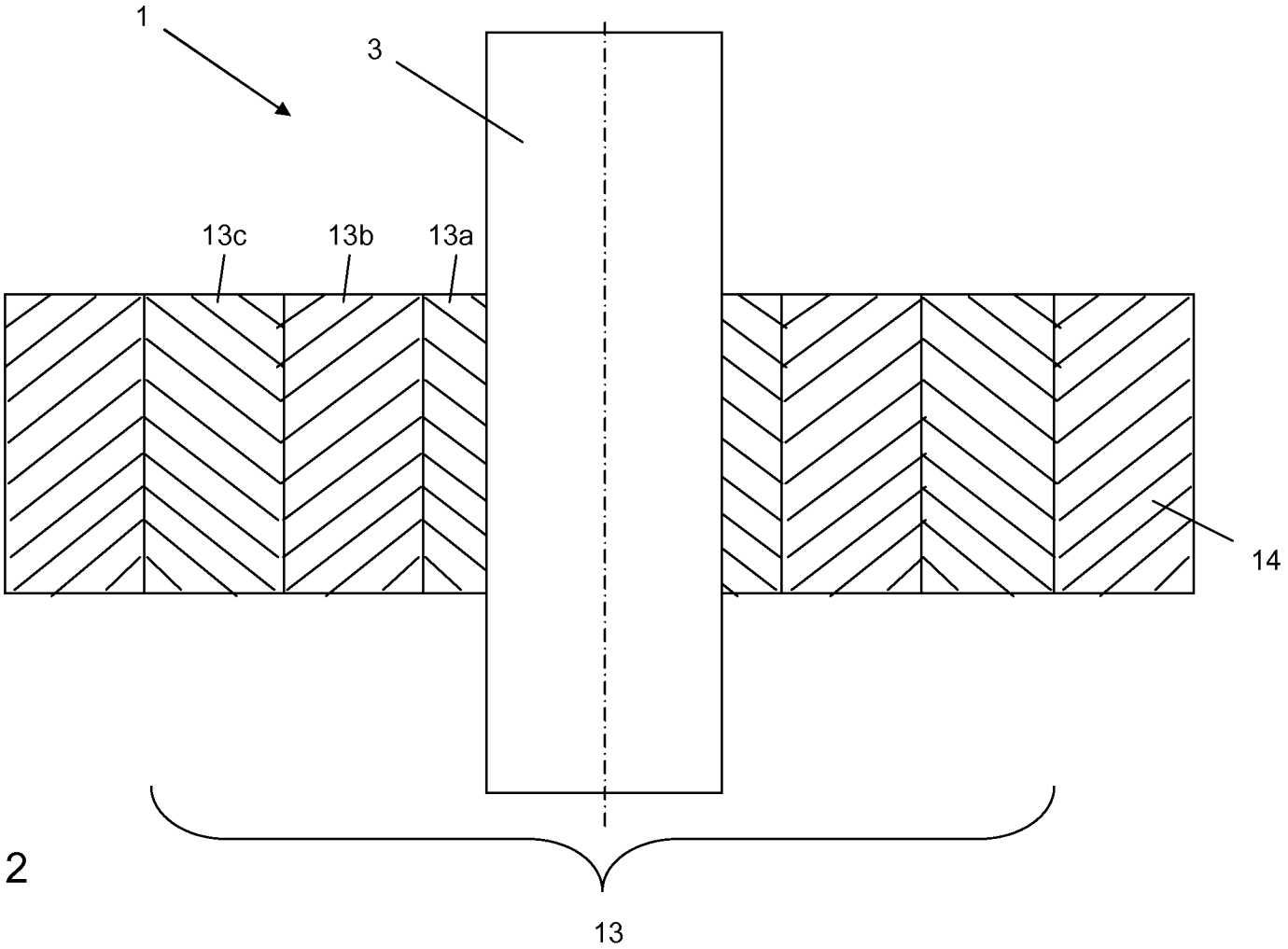
FIG. 2 shows a schematic sectional view of a grinding roller according to a first embodiment.

In FIG. 2, the connections between the intermediate ring 13*a* and the shaft 3 as well as between the intermediate rings and the connection between the outer intermediate ring 13*c* and the wear ring 14 are made by means of a cylindrical shrink fit.

Figure 3:
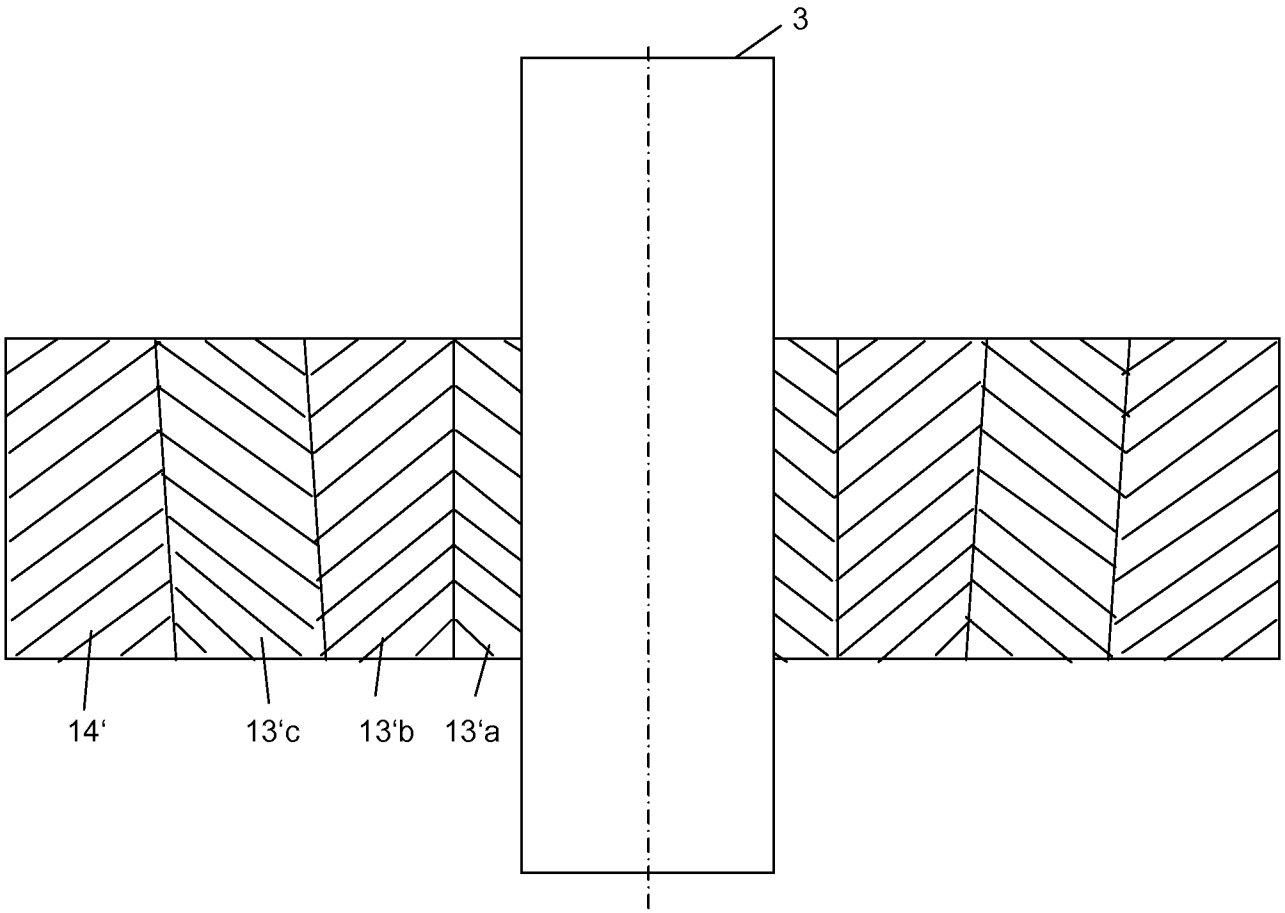
FIG. 3 shows a schematic sectional view of a grinding roller according to a second embodiment.

In the exemplary embodiment according to FIG. 3, the connections between the two intermediate rings 13'*c* and 13'*b* and between the wear ring 14' and the intermediate ring 13'*c* are provided by means of a conical shrink fit. The conical shrink fit allows the connection to be dismantled more easily, should that become necessary later during conditioning.

Instead of the three intermediate rings, however, it is also possible to provide four or even more intermediate rings, in order thus to form grinding rollers which have a diameter of 3 m, 3.5 m, 4 m, 4.5 m or more. It is accordingly possible for the first time to produce grinding rollers with very large diameters, so that roller mills with a correspondingly higher throughput can be produced.

The grinding roller according to the invention can initially be conditioned repeatedly simply by treatment of the wear ring. As soon as the wear ring does not permit further conditioning and the roller body is also affected, only the outermost intermediate ring 13*c* or 13'*c* of the roller body must be replaced. The remainder of the roller body can therefore continue to be used. Of course, it is instead possible also to convert a large grinding roller into a correspondingly smaller grinding roller by removing the worn outer intermediate ring. The operating costs of a grinding roller can be reduced considerably in that manner.

The invention claimed is:

1. Grinding roller of a roller mill, having a roller shaft, a main roller body, and an outer wear ring having wear protection, the connection between the roller shaft and the main roller body being formed by a shrink fit, characterised in that the main roller body is formed by at least 3 coaxially arranged intermediate rings.

2. Grinding roller according to claim 1, characterised in that the connections between the intermediate rings and the wear ring are likewise formed by a shrink fit.

3. Grinding roller according to claim 2, characterised in that the shrink fit is in conical or cylindrical form.

4. Grinding roller according to claim 1, characterised in that the diameter of the grinding roller is at least 3.00 m.

5. Grinding roller according to claim 1, characterised in that the diameter of the grinding roller is at least 4.50 m and the width is at least 2.00 m.

6. Grinding roller according to claim 1, characterised in that the wear protection is formed by shaped bodies which protrude from the surface of the wear ring and/or by a hard build-up weld.

7. Roller mill for the comminution of brittle grinding stock, having two grinding rollers according to claim 1, wherein the two grinding rollers are driven in opposite directions.

8. Roller mill according to claim 7, characterised in that the roller mill is formed by a high-pressure roller mill which comprises a force application system that is in operative connection with at least one grinding roller for generating a grinding pressure of at least 50 MPa.

9. Roller mill according to claim 8, characterised in that the roller shafts of the grinding rollers are mounted in slide bearings.

* * * * *